US005336384A

United States Patent [19]

Tsou et al.

[11] Patent Number: 5,336,384

[45] Date of Patent: Aug. 9, 1994

[54] MEMBRANE-ELECTRODE STRUCTURE FOR ELECTROCHEMICAL CELLS

[75] Inventors: Yu-Min Tsou; James W. McMichael, both of Lake Jackson, Tex.; Richard N. Beaver, deceased, late of Angleton, Tex., by Wanda G. Beaver, legal representative

[73] Assignee: The Dow Chemical Company, Midland, Mich.

[21] Appl. No.: 82,810

[22] Filed: Jun. 25, 1993

Related U.S. Application Data

[63] Continuation of Ser. No. 792,325, Nov. 14, 1991, abandoned.

[51] Int. Cl.[5] ..... C25B 11/20

[52] U.S. Cl. ..... 204/252; 204/283; 204/290 R

[58] Field of Search ..... 204/282, 283, 252, 290 R, 204/98; 429/41, 42, 44; 427/77, 126.3, 336, 341

[56] References Cited

U.S. PATENT DOCUMENTS 4,389,297 6/1983 Korach ..... 204/290 R
4,652,356 3/1987 Oda et al. ..... 204/98
4,749,452 6/1988 LaConti et al. ..... 204/283
4,822,544 4/1989 Coker et al. ..... 264/104
4,832,805 5/1989 LaConti et al. ..... 204/98
4,992,126 2/1991 Door ..... 156/182

FOREIGN PATENT DOCUMENTS 0061080 9/1982 European Pat. Off. .

OTHER PUBLICATIONS

56133481 Yoshio et al., Electrolytic Cell, Oct. 19, 1981, vol. 6, No. 11.
57089490 Yoshio et al., Electrolytic Cell Provides With Ion Exchange Membrane, Mar. 6, 1982 vol. 6, No. 174.

*Primary Examiner*—Kathryn Gorgos

[57] ABSTRACT

A membrane-electrode structure for use in an electrochemical cell comprising an ion exchange membrane with a cathode layer and several intermediate layers between the cathode and the membrane. The intermediate layers comprises at least two layers or zones of inorganic solid particles and an organic polymer binder. The intermediate layer or zone adjacent to the membrane comprises more than 50% by weight of inorganic particles and the other layers or zones have 50% by weight or less of inorganic particles.

25 Claims, 1 Drawing Sheet

MEMBRANE-ELECTRODE STRUCTURE FOR ELECTROCHEMICAL CELLS

This is a continuation of application Ser. No. 07/792,325, filed Nov. 14, 1991, now abandoned.

FIELD OF THE INVENTION

The present invention relates to an improved membrane-electrode structure for use in an ion exchange membrane electrolytic cell. More particularly, the invention is concerned with the use of two or more intermediate layers for the membrane-electrode structure of chlor-alkali electrolyzers to reduce the amount of hydrogen in chlorine and to improve the bonding of the electrode layer to the membrane.

BACKGROUND OF THE INVENTION

It is known to attain an electrolysis by a so called solid polymer electrolyte type electrolysis of an alkali metal chloride wherein a cation exchange membrane of a fluorinated polymer is bonded with a gas-liquid permeable catalytic anode on one surface and/or a gas-liquid permeable catalytic cathode on the other surface of the membrane (British Pat. No. 2,009,795, U.S. Pat. Nos. 4,210,501 and 4,214,958 and 4,217,401).

This prior art electrolytic method is remarkably advantageous as an electrolysis at a lower cell voltage because the electric resistance caused by the electrolyte and the electric resistance caused by bubbles of hydrogen gas and chlorine gas generated in the electrolysis can effectively be decreased. This has been considered to be difficult to attain in the electrolysis with cells of other configurations.

The anode and/or the cathode in this prior art electrolytic cell are bonded on the surface of the ion exchange membrane so as to be partially embedded. The gas and the electrolyte solution are readily permeated so as to remove from the electrode, the gas formed by the electrolysis at the electrode layer contacting the membrane. That is, there are few gas bubbles adhering to the membrane after they are formed. Such a porous electrode is usually made of a thin porous layer which is formed by uniformly mixing particles which act as an anode or a cathode with a binder. U.S. Pat. No. 4,822,544 to Coker et al, which is herein incorporated by reference, discloses a method of fabricating such a membrane-electrode structure. However, it has been found that when an electrolytic cell having an ion exchange membrane bonded directly to the electrode is used, the anode in the electrolytic cell is brought into contact with hydroxyl ions which migrates back from the cathode compartment. Accordingly, both chlorine resistance and alkaline resistance for anode material are required for this prior method and an expensive material must be used. When the electrode layer is directly bonded to the ion exchange membrane, a gas is formed by the electrode reaction between an electrode and membrane and certain deformation phenomenon of the ion exchange membrane causes the characteristics of the membrane to deteriorate. In such an electrolytic cell, the current collector for the electric supply to the electrode layer which is bonded to the ion exchange membrane, should closely contact the electrode layer. When a firm contact is not obtained, the cell voltage may be increased. Therefore, the cell structure for securely contacting the current collector with the electrode layer according to this reference is disadvantageously complicated.

Additionally, in chlor-alkali electrolyzers where the cathode is directly bound to the membrane, there is permeation of hydrogen through the membrane into the anolyte compartment which mixes with the chlorine. High percentages of hydrogen are then found in the chlorine so as to cause problems in the liquefaction process. Prior means for reducing the hydrogen percentage include 1) the use of a platinum black layer on the anode side of the membrane, and 2) the use of a layer (e.g. Ag) less electroactive than the electrode layer itself between the membrane and the electrode. These methods have proved to be expensive and ineffective.

Perfluoro membranes which are used as membranes for electrolysis reactions usually have fairly low water contents. As compared with conventional ion exchangers with the same amount of water contents, the conductivity of the perfluoro membranes are abnormally high. This is because of phase separation existing in the perfluoro ionic membranes. The phase separation greatly reduces the tortuosity for sodium ion diffusion. The hydrogen diffusion path is the aqueous ionic region and the amorphous fluorocarbon region. Therefore, the tortuosity experienced by the hydrogen molecules is also low for the phase-segregated fluorocarbon membranes as compared with conventional hydrocarbon ionic membranes.

The phase-segregation characteristics of the fluorocarbon membranes provides the high migration rates for sodium ions. Thus, relatively lower ionic resistivity is also the cause for the high hydrogen diffusion rates and the resulting high percentage of hydrogen in chlorine. Moreover, the high permeation rate of hydrogen is even more enhanced by the high solubility of hydrogen in the fluorocarbon membranes because of the hydrophobic interaction between hydrogen molecules and the fluorocarbon chains. Therefore, reducing hydrogen permeation rates by increasing the thickness of the membranes or modifying the structure of the membranes would not be very effective because the sodium migration rate would be reduced as one tries to reduce the hydrogen diffusion rate; and the tortuosity effect is difficult to introduce because of the phase separation.

A retardation layer is defined as a layer between the electrode layer and the membrane to retard hydrogen permeation. Any kind of layer can have a certain effect to retard hydrogen permeation as long as it is (1) inactive for electrolytic hydrogen generation, and (2) flooded. The latter requirement is also important for low resistance ( i.e., lower voltage and good performance). With these considerations, a layer of a blend of inert solid particles (usually inorganic) and binders (usually organic) would serve the purpose best.

The need for a binder is obvious: the binder can (1) bind the components in the retardation layer together and also (2) provide the necessary adhesion between the retardation layer and the electrode layer and that between the retardation layer and the membrane. The function of the solid particles is also two fold: (1) providing the physical strength to the retardation layer so that there is very limited interpenetration between different layers during fabrication, and (2) forming an agglomerate with the binder.

The reason that the retardation layer is better than the membrane itself in retarding hydrogen permeation is because (1) it allows hydroxide ions and sodium ions to migrate at a faster rate so that a relatively small voltage penalty has to be paid. On the other hand, in the membrane, sodium ion diffusion is slowed down by the coulombic interaction exerted by the sulfonate or carboxylate groups. The situation is even worse when the membrane is immersed in strong caustic solution as in the chlor-alkali membrane. This is particularly severe for the carboxylic membranes. Ion pairing between sodium ion and carboxylate groups and hydroxide ions is believed to be the cause for the very slow diffusion rate when membrane dehydration occurs under this condition. The solubility of hydrogen is much lower in caustic solution than in the membrane, so the permeation rate (the product of diffusion coefficient and solubility) of hydrogen can be reduced by a larger factor compared with that of the sodium and hydroxide ions. By introducing the blend of inorganic particles and binder and with the necessary morphology, the resistance of the caustic solution is increased. The ratio of the resistivity of the porous medium saturated with electrolyte, $R_p$, to the bulk resistivity of the same electrolyte solution, $R_b$ is commonly called "formation resistivity factor", $$F=R_p/R_b=X/O$$

This equation describes the relationship between F and "electric tortuosity", X, and 0, the porosity. The symbol X is different from hydraulic tortuosity which takes into account the fact the effective path length of the ionic species is increased by the presence of impermeable blocking materials. On the other hand, X also takes into account the special effects due to convergent-divergent nature of the capillaries, called constrictedness, besides the hydraulic tortuosity.

Since conductivity is proportional to diffusion rate of the ionic species, formation resistivity factor is also related to diffusion rate in the porous medium, $D_p$, and the diffusion rate in the bulk electrolyte, $D_b$, by the following equation:

$$F=R_p/R_b=D_b/D_p$$

U.S. Pat. No. 4,832,805 to La Conti et al discloses a membrane-electrode assembly for electrolysis processes with multiple layers having different overvoltages. There is a layer attached to the membrane which has a higher overvoltage for the electrolysis process than the electrode attached to its upper surface. The intermediate layer comprises a polymeric binder such as tetrafluoroethylene and conductive metal or carbon particles.

U.S. Pat. No. 4,468,499 to Seigfried et al, which is herein incorporated by reference, discloses chemically blended interpenetration polymer network compositions and their preparation. Such interpenetration polymer network compositions are useful in the present invention.

SUMMARY OF THE INVENTION

The present invention provides a membrane-electrode structure for use an electrolytic cell, particularly a chlor-alkali cell. The membrane-electrode structure comprises an ion exchange membrane with an electrode layer and a barrier between the membrane and the electrode layer. The barrier (i.e., the retardation layer) comprises at least two layers or zones formed from a blend of inorganic particles and an organic thermoplastic polymeric binder having a melting point of about 230° F. to 540° F. The first retardation layer is adjacent to the membrane and is an inorganic particle rich layer, namely, having more than 50% by weight of inorganic solid particles. The second retardation layer or zone is adjacent the first retardation layer and is an inorganic particle poor layer, namely, having 50% by weight or less of inorganic solid particles.

Advantageously, the retardation layers have decreasing amounts of inorganic particles as they near the electrode layer so as to provide better bonding with the electrode layer.

Advantageously, a retardation layer or coating is provided adjacent to the electrode layer which is free of inorganic particles to prevent contact of inorganic particles with the catalyst material.

Preferably, the retardation layer adjacent to the membrane comprises about 65% to 75% by weight inorganic particles. Even more preferably, about 70% by weight of inorganic particles and 30% polymeric binder.

As described above, the function of the retardation layer is to provide porosity and tortuosity to impede hydrogen diffusion. A retardation layer with porosity in the range of 5% to 90% is prepared; it is preferable to have a porosity in the range of 20% to 60%, more preferably, in the range of 30% to 50%.

Advantageously, the tortuosity/porosity ratio is in the range of 2–500, preferably in the range of 5–100, and more preferably in the range of 10–50.

Preferably, the second retardation layer comprises about 50% by weight of inorganic particles and 50% by weight of polymeric binder. The retardation layers are formed utilizing a blend of inorganic particles and organic particles. The inorganic particles have a size of about 0.1 to 1.0 microns, preferably about 0.2 to 0.4 microns. The organic binder is about 0.1 to 5 microns.

The inorganic solid particles comprise one or more of the borides, carbides and nitrides of metals of Groups IIIB, IVA, IV B, VB and VI B of the Periodic Table. Typical examples of suitable materials include SiC, YC, VC, TiC, BC, TiB, HfB, $BV_2$, $NbB_2$ $MOB_2$, $W_2B$, VN, $Si_3N_4$, $ZiO_2$, NbN, BN and TiB. Preferably, silicon carbide is used.

It is understood that the term "retardation layers" is meant to include laminates as well as an interpenetration polymer network compositions having zones of the inorganic particles.

The binder which is used in the invention preferably comprises a perfluorinated ion exchange polymers which can be used alone or blended with a non-ionic thermoplastic binders. The preferred polymers are copolymers of the following monomer I with monomer II.

Monomer I is represented by the general formula:

$$CF_2=CZZ' \quad (I)$$

where;

Z and Z' are independently selected from the group consisting of —H, —Cl, —F, or $—CF_3$.

Monomer II consists of one or more monomers selected from compounds represented by the general formula;

$$Y—(CF_2)_a—(CFR_f)_b—(CFR_f)_c—O—[CF(CF_2X)—CF_2—O]_n—CF=CF_2 \quad (II)$$

where;

Y is $—SO_2Z$

Z is —I, —Br, —Cl, —F, —OR, or $—NR_1R_2$;

R is a branched or linear alkyl radical having from 1 to about 10 carbon atoms or an aryl radical;

$R_1$ and $R_2$ are independently selected from the group consisting of —H, a branched or linear alkyl radical having from 1 to about 10 carbon atoms or an aryl radical;

a is 0–6;

b is 0–6;

c is 0 or 1;

provided a+b+c is not equal to O;

X is —Cl, —Br, —F, or mixtures thereof when n>1;

n is O to 6; and $R_f$ and $R_f$ are independently selected from the group consisting of —F, —Cl, perfluoroalkyl radicals having from 1 to about 10 carbon atoms and fluorochloroalkyl radicals having from 1 to about 10 carbon atoms.

It is, therefore, an object of the invention to provide a membrane-electrode structure for use in an electrolysis cell which provides improved adhesion of the electrode layer.

It is a further object of the invention to provide a membrane-electrode structure for use in a chlor-alkali cell which will reduce the amount of hydrogen in the chlorine.

Other objects and a fuller understanding of the invention will be had by referring to the following description and claims taken in conjunction with the accompanying drawing.

DESCRIPTION OF THE PREFERRED EMBODIMENT

Figure 1:
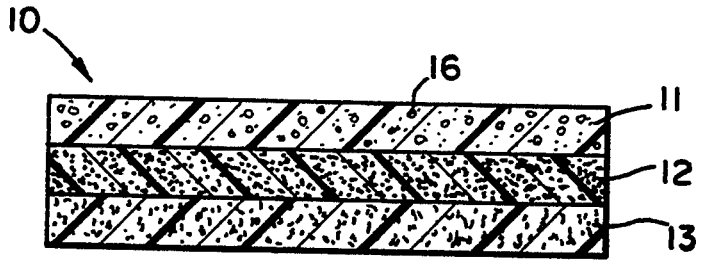
FIG. 1 PRIOR ART
FIG. 1 is a cross-sectional view of a prior art membrane-electrode structure with a retardation layer.

Although specific terms are used in the following description for the sake of clarity, these terms are intended to refer only to the particular structure of the invention selected for illustration in the drawings, and are not intended to define or limit the scope of the invention.

As shown in FIG. 1, the prior art has provided a membrane-electrode structure 10 wherein at least one electrode layer 11 is formed on an ion exchange membrane 13 with an intermediate porous non-electrode layer 12. The non-electrode layer 12 is formed with inorganic particles 17 and a binder of a fluorinated polymer.

Figure 2:
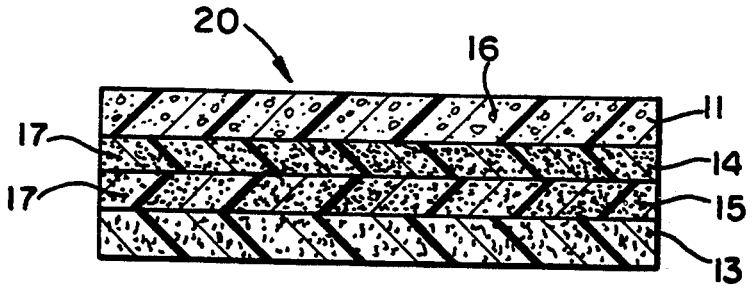
FIG. 2 is a cross-sectional view of a membrane-electrode structure of the invention.

FIG. 2 illustrates a membrane-electrode structure 20 of the invention. The structure 20 is formed by an ion exchange membrane 13 which has bonded to it a layer 15 of thermoplastic polymeric material and inorganic particles which comprises an inorganic particle rich layer, and a layer 14 of thermoplastic polymeric material and inorganic particles which comprises an inorganic particle poor layer. Bonded to the inorganic particle poor layer 14 is a catalyst layer 11 comprising catalyst material 16 and a binder. The separate layers 14,15 are generally about 0.3 to 1.5 mils in thickness, preferably about 0.4 mil.

Figure 3:
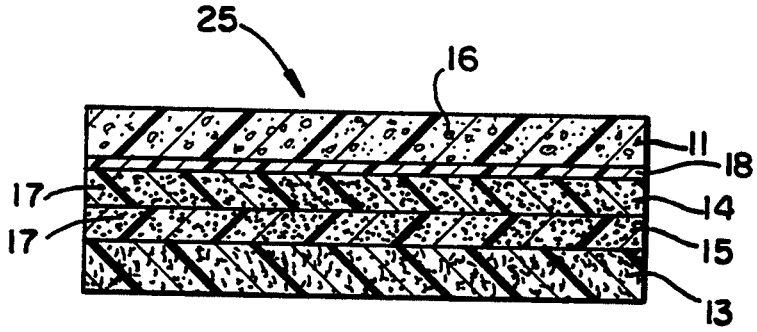
FIG. 3 is a cross-sectional view of a further embodiment of the invention.

FIG. 3 illustrates a further embodiment of the invention wherein a membrane-electrode structure 25 is provided with a retardation layer comprising three layers or zones of decreasing amounts of inorganic particles as the layer is closer to the electrode layer. The structure 25 is provided with an ion exchange membrane 13 having adjacent to it a retardation layer 15 comprising the inorganic particles 17 and a polymeric binder. Layer 15 is comprised of more than 50% by weight of the inorganic particles 17, preferably about 65–80%. Bonded to the layer 15 is layer 14 which contains a polymeric binder and lower percentage amount of inorganic particles than found in layer 15, namely, 50% by weight of inorganic particles. A layer or zone 18, which is free of any inorganic particles, is bonded or formed adjacent to layer 14. The object of layer 18 is to provide a pure binder are a which can help build good adhesion between the electrode layer (which usually has low binder content) and the retardation layer.

The barrier layer 18 is generally sprayed onto layer 14 by placing the polymeric binder in a suitable solvent. The thickness of layer 18 is about 0.1 to 0.2 mils. Layers 14 and 15 are each about 0.3 to 1.5 mils, preferably about 0.4 mils in thickness. In accordance with the present invention, at least one of the electrodes, preferably, the cathode, is bonded to the ion exchange membrane through the retardation layer for use in an electrolytic cell, particularly a chlor-alkali cell.

When the membrane-electrode structure of the invention is used in an electrolytic cell, the cell voltage can be reduced in comparison with the electrolysis in a chlor-alkali cell in which the electrode is in direct contact (but not bound to) with the membrane such as a zero gap cell.

The barrier composition for preparing the retardation layer is preferably in the form of a suspension of agglomerates of particles and binders having an agglomerate size of about 0.1 to 10 microns, preferably about about 1 to 4 microns. The suspension can be formed with an organic solvent which can be easily removed by evaporation, such as halogenated hydrocarbons, alkanols, ethers, and the like. Preferable is FREON, (trichlorofluoromethane sold by Dupont). The suspension may include nonionic thermoplastic binders as well.

The suspension can be applied to the ion exchange membrane or its adjacent layer by spraying, brushing, screen-printing, and the like as disclosed in U.S. Pat. No. 4,185,131.

The retardation layer can be prepared in a single step by continuously spraying onto a membrane. Alternatively, a series of steps can be employed. That is, after the first barrier is formed, the organic solvent is evaporated and the first barrier composition is heat pressed on the membrane by a roller or press at 80° to 220° C. under a pressure of 0.01 to 150 kg/cm$^2$ to bond the layer to the membrane. The next barrier layer is formed and heat pressed on the first barrier layer under the same conditions. The polymer is applied in a non-hydrolyzed state and is thereafter hydrolyzed.

The total barrier is about 0.3 to 2 mils in thickness, preferably about 0.4–1.0 mils.

The cation exchange membrane on which the porous non-electrode layer is formed, can be made of a polymer having cation exchange groups such as carboxylic acid groups, sulfonic acid groups, phosphoric acid groups and phenolic hydroxy groups. Suitable polymers include copolymers of a vinyl monomer such as tetrafluoroethylene and chlorotrifluoroethylene, and a perfluorovinyl monomer having an ion-exchange group, such as a sulfonic acid group, carboxylic acid group and phosphoric acid group or a reactive group which can be converted into the ion-exchange group. It is also possible to use a membrane of a polymer of trifluoroethylene in which ion-exchange groups, such as sulfonic acid groups, are introduced or a polymer of styrene-divinyl benzene in which sulfonic acid groups are introduced.

The cation exchange membrane is preferably made of a fluorinated polymer having the following units:

$$\text{(M)}\quad (CF_2-CXX')\quad \text{(M mole \%)}$$
$$\text{(N)}\quad (CF_2-\underset{\underset{Y-A}{|}}{CX})\quad \text{(N mole \%)}$$

wherein X represents fluorine, chlorine or hydrogen atom, or $-CF_3$; X' represents X or $CF_3(CH_2)_m$; m represents an integer of 1 to 5.

The typical examples of Y have the structures bonding A to fluorocarbon group such as $$\left(CF_2\right)_x-O\left(CF_2\right)_x\left(O-CF_2-\underset{\underset{Z}{|}}{CF}\right)_y-$$

$$-CF_2\left(O-CF_2-\underset{\underset{Z}{|}}{CF}\right)_y-$$

$$\left(O-CF_2-\underset{\underset{Z}{|}}{CF}\right)_x\left(O-CF_2-\underset{\underset{Rf}{|}}{CF}\right)_y$$

and $$-O-CF_2\left(\underset{\underset{Z}{|}}{CF}-O-CF_2\right)_x\left(CF_2\right)_y\left(CF_2-O-\underset{\underset{Rf}{|}}{CF}\right)_z$$

x, y and z respectively represent an integer of 1 to 10; Z and Rf represent —F or a $C_1$–$C_{10}$ perfluoroalkyl group; and A represents —COOM or $SO_3M$, or a functional group which is convertible into —COOM or $-SO_3M$ by, hydrolysis or neutralization, such as —CN, —COF, $-COOR_1$, $-SO_2F$ and $-CONR_2R_3$ or $-SO_2NR_2R_3$, and M represents hydrogen or an alkali metal atom, and $R_1$ represents a $C_1$–$C_{10}$ alkyl group.

It is preferable to use a fluorinated cation exchange membrane having an ion exchange group content of 0.5 to 4.0 miliequivalence/gram dry polymer, especially 0.8 to 2.0 miliequivalence/gram dry polymer, which is made of said copolymer.

In the cation exchange membrane of a copolymer having the units (M) and (N), the ratio of the units (N) is preferably in a range of 1 to 40 mol % preferably 3 to 25 mol %.

The cation exchange membrane used in this invention is not limited to one made of only one kind of polymer. It is possible to use a laminated membrane made of two kinds of polymers having lower ion exchange capacity in the cathode side, for example, having a weak acidic ion exchange group such as a carboxylic acid group in the cathode side and a strong acidic ion exchange group, such as a sulfonic acid group, in the anode side.

The cation exchange membrane used in the present invention can be fabricated by blending a polyolefin, such as polyethylene, polypropylene, preferably a fluorinated polymer, such as polytetrafluoroethylene, and a copolymer of ethylene and tetrafluoroethylene.

The electrode used in the present invention has a lower over-voltage than that of the material of the porous non-electrode layers. Thus, the anode has a lower chlorine over-voltage than that of the porous layer at the anode side and the cathode has a lower hydrogen over-voltage than that of the layer at the cathode side in the case of the electrolysis of alkali metal chloride. The material of the electrode used depends on the material of the retardation layers bonded to the membrane.

The anode is usually made of a platinum group metal or alloy, a conductive platinum group metal oxide or a conductive reduced oxide thereof.

The cathode is usually a platinum group metal or alloy, a conductive platinum group metal oxide or an iron group metal or alloy or silver.

The platinum group metal can be Pt, Rh, Ru, Pd, Ir. The cathode is iron, cobalt, nickel, Raney nickel, stabilized Raney nickel, stainless steel, a stainless steel treated by etching with a base (U.S. Ser. No. 87,951) Raney nickel plated cathode (U.S. Pat. Nos. 4,170,536 and 4,116,804) nickel rhodanate plated cathode (U.S. Pat. Nos. 4,190,514 and 4,190,516).

The preferred cathodic materials for use with the retardation layers of the present invention are Ag and $RuO_2$.

The membrane may be prepared according to the procedures fully described in U.S. Pat. Nos. 4,554,112; 4,337,211; 4,578,512; 4,834,922; 4,804,727; 4,358,412; 4,515,989; 4,687,821; 4,330,654; 4,470,889; 4,358,545; 4,417,969; 4,478,695; 4,337,137; and 4,462,877.

The preferred polymers used as binders in the present invention desirably have a water absorption within a certain desired range. It is possible to tailor the polymer preparation steps in a way to produce a polymer having a water absorption within the desired range. The water absorption is somewhat dependent upon the equivalent weight of the polymer. The effect of equivalent weight on water absorption is fully discussed in "Perfluorinated Ion Exchange Membranes" The Electrochemical Society, Houston, Tex., May 7–11, 1972, W. G. F. Grot, G. E. Munn and P. N. Walmsley.

The preferred polymers used as binders in the present invention desirably have an equivalent weight within a certain desired range, namely 550 to 1200. It is possible to tailor the polymer preparation steps in a way to produce a polymer having an equivalent weight within the desired range. Equivalent weight is a function of the relative concentration of the reactants in the polymerication reaction. The effect of the ratio of copolymerization reactants on the equivalent weight of the final products is addressed in *Emulsion Polymerization-Theory and Practice,* by D. C. Blackley, published by John Wiley & Sons.

The preferred polymeric binders of the present invention desirably have a melt viscosity within a certain desired range. It is possible to tailor the polymer preparation steps in a way to produce a polymer having a melt viscosity within the desired range. The melt viscosity is based upon the concentration of the initiator and by the temperature of the reaction. Controlling the melt viscosity of polymers is discussed fully in *Emulsion Polymerization-Theory and Practice,* by D. C. Blackley, published by John Wiley & Sons.

The polymer obtained by one of the above process is then hydrolyzed in an appropriate basic solution to convert the nonionic thermoplastic form of the polymer to the ionic functional form which will have ion transport properties. The hydrolysis step is particularly important in the process, because during the hydrolysis step, the nonfunctional polymer is heated and reacted as shown below during which process, the polymer is softened and swollen with moisture in a controlled manner. Incomplete hydrolysis leaves covalently bonded functional groups whose lack of mobile ions lead to insulating regions within the membrane. The density of the hydrolysis solution is preferably between about 1.26 and about 1.28 grams per ml at ambient temperature. The hydrolysis process requires two moles of NaOH for each mole of the functional group in the polymer, as shown in the following equation:

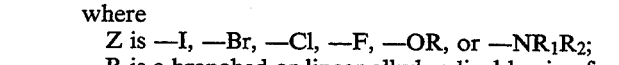

$$-CF_2SO_2Z+2NaOH \rightarrow -CF_2SO_3Na+NaZ+H_2O$$

where

Z is —I, —Br, —Cl, —F, —OR, or $-NR_1R_2$;

R is a branched or linear alkyl radical having from 1 to about 10 carbon atoms or an aryl radical;

$R_1$ and $R_2$ are independently selected from the group consisting of —H, a branched or linear alkyl radical having from 1 to about 10 carbon atoms or an aryl radical, preferably phenyl or a lower alkyl substituted phenyl.

For hydrolysis, the copolymers are placed in the hydrolysis bath at room temperature, with inert, mesh materials holding the copolymers in the liquid, making sure that there are no trapped bubbles. The bath is then heated from about 60° C. to about 90° C. and then held at that temperature for a minimum of four hours to insure complete hydrolysis and expansion to the correct level.

After the hydrolysis heating step, the bath is allowed to cool to room temperature and the polymers are then removed from the bath and rinsed with high purity deionized water, then placed in a deionized water bath to leach out residual ionic substances.

The present invention will be further illustrated by certain examples and references which are provided for purposes of illustration only and are not intended to limit the present invention.

EXAMPLE I

Preparation of Binder

This example shows the preparation of a sulfonic fluoropolymer binder having an equivalent weight of about 794 and a low shear melt viscosity of about 50,000 poise (dyne sec-cm$^{-2}$) at 250° C. and 4.25 sec$^{-1}$ and a 100° C. water absorption of about 50%.

A 132 liter glass-lined reactor equipped with an anchor agitator, H-baffle, a platinum resistance temperature device, and a temperature control jacket is charged with about 527 grams of ammonium perfluorooctanoate, about 398.4 grams of $Na_2HPO_47H_2O$, about 328.8 grams $NaH_2PO_4H_2O$ and about 210.8 grams of $(NH_4)_2S_2O_8$. The reactor is then evacuated down to about 0.0 atmosphere, as measured on the electronic pressure readout, and then an inert gas (nitrogen) is added to pressure up the reactor to a pressure of about 448 kPa. This is done a total of 4 times, then the reactor is evacuated one more time. About 99 liters of deoxygenated, deionized water is added, the agitator is started and heat is applied to the jacket. An agitator is set to about 250 revolutions per minute (rpm) and then about 15 ml of a terminating agent such as isopropyl alcohol is added, followed by about 16.65 kg of 2-fluorosulfonyl perfluoroethyl vinyl ether is added. When the temperature reaches about 50° C., tetrafluoroethylene (TFE) gas is fed to the reactor at a rate of from about 0.5 to about 0.567 kg per minute, until a pressure of about 1060 kPa is reached over a period of about 17 minutes. The feed is continued until a total of about 18.18 kg. of TFE has been added to the reactor. At this time, the feed is stopped and then nitrogen is blown through the gas phase portion of the system and ambient temperature water is added to the reactor jacket. The materials react to form a latex. The latex is transferred to a larger vessel for separation and stripping of residual monomer. After the contents are allowed to settle, a bottom dump valve is opened to allow separate phase monomer to be drained away. The vessel is then heated and a vacuum is applied to remove any further monomer components. After this, a brine system circulates about 20° C. brine through cooling coils in the vessel to freeze the latex, causing coagulation into large polymer agglomerates. After freezing is completed, the latex is allowed to thaw with slight warming (room temperature water), and the latex is transferred into a centrifuge where it is filtered and washed repeatedly with deionized water. The latex polymer cake is then dried overnight in a rotary cone dryer under vacuum (about 969 Pa) at about 110° C. The water content of the polymer is tested by Karl Fischer reagent and found to be about 140 ppm. The isolated polymer is weighed and found to be about 23,18 kg. The equivalent weight of the above polymer is determined to be 794.

The binder can be prepared in either thermoplastic form or ionic form. To prepare it in the thermoplastic form, the dried polymer is dispersed in a suitable solvent and attrited to a fine dispersion.

To prepare it in ionic form, the polymer is then hydrolyzed in an approximately 25 weight percent NaOH solution. The density of the hydrolysis solution is between about 1.26 and about 1.28 grams per ml at ambient temperature. The hydrolysis process consumes two moles of NaOH for each mole of the functional group in the polymer, as shown in the following equation:

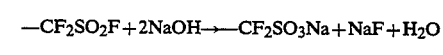

$$-CF_2SO_2F+2NaOH \rightarrow -CF_2SO_3Na+NaF+H_2O$$

The polymers are placed in the hydrolysis bath at room temperature, with inert, mesh materials holding the polymers; the liquid-making sure that there are no trapped bubbles. The bath is then heated to about 60° C. to about 90° C. and then held at that temperature for a minimum of four hours to insure complete hydrolysis and expansion to the correct level.

After the hydrolysis heating step, the bath is allowed to cool to room temperature and the polymers are then removed from the bath and rinsed with high purity deionized water, then placed in a deionized water bath to leach out residual ionic substances.

EXAMPLE 2

Two suspensions of particles of SiC and the copolymer of Example 1 were formed in FREON. One suspension contained a ratio of SiC to copolymer of 70:30, the other of 50:50. They are prepared by adding SiC powder to an appropriate polymer dispersion prepared in accordance with Example 1 and then suitable amounts of solvent is added to adjust the viscosity. The 70:30 suspension was sprayed onto a high performance sulfonic/carboxylic bilayer ion exchange membrane of Dow to form a layer about 0.4 mil in thickness. The second suspension containing a ratio of 50:50 of particles was then sprayed onto the first layer to form a second layer of about 0.4 mil in thickness. If desired, TEFLON (polyetrafluoroethylene sold by Dupont) particles may be added to each of the suspensions in an amount of about 10% by weight of total composition. An electrode layer of $Ag/RuO_2$/binder (76%:10%:8%) of about 1 mil in thickness was then sprayed on tope of the second layer. The three layers and the membrane were then heated at 400° F. and pressed together at about 0.5–1000 PSI.

If desired, an inorganic particle-free layer may be sprayed between the second SiC/binder layer and the electrode layer so as to amount to about 0.6% by weight of the retardation layer.

The electrode/retardation layer/membrane assembly is then treated to obtain final form for electrolysis. This could involve hydrolysis in an appropriate solution to hydrolyze the membrane and/or the binder (if in thermoplastic form).

What is claimed is:

1. A membrane-electrode structure for use in electrochemical cells which comprises an ion exchange membrane with an electrode layer, and intermediate layers between said membrane and said electrode layer, said intermediate layers comprising at least two layers or zones of inorganic solid particles and an organic binder polymer having a melting point of about 230° F. to 540° F., a first intermediate layer or zone being adjacent to said membrane and comprising more than 50% by weight of inorganic particles, a second intermediate layer or zone being adjacent to said first intermediate layer and the electrode layer and comprising 50% by weight or less of inorganic particles.

2. The structure of claim 1 wherein said first intermediate layer comprises about 65 to 70% by weight of inorganic particles.

3. The structure of claim 2 wherein said first intermediate layer comprises about 70% by weight of inorganic particles and about 30% by weight of polymers.

4. The structure of claim 1 wherein said second intermediate layer comprises about 50% by weight of inorganic particles.

5. The structure of claim 1 wherein the tortuosity/porosity ratio of said first intermediate layer is in the range of 2–500 and the porosity is in the range of 5%–90%.

6. The structure of claim 1 including a coating of an organic ionic conductive material free of inorganic particles adjacent to said electrode layer.

7. The structure of claim 1 wherein said inorganic solid particles comprising at least one of the borides, carbides, and nitrides of metals of Groups IIIB, IVA, IVB, VB, and VIB of the Periodic Table.

8. The structure of claim 7 wherein said inorganic particles are silicon carbide.

9. The structure of claim 1 wherein said polymer consists of a copolymer of a monomer of the general formula:

$$CF_2{=}CZZ' \qquad \text{(I)}$$

wherein

Z and Z' are independently selected from the group consisting of —H, —Cl, —F, and $—CF_3$, and at least one monomer selected from compounds represented by the general formula:

$$Y—(CF_2)_a—(CFR_f)_b—(CFR_f)_c—O—[CF(CF_2X—)—CF_2O]_n—CF{=}CF_2 \qquad \text{(II)}$$

wherein

Y is $—SO_2Z$

Z is —I, —Br, —Cl, —F, —OR or $—NR_1R_2$;

wherein

R is a branched or linear alkyl radical having from 1 to about 10 carbon atoms or an aryl radical;

$R_1$ and $R_2$ are independently selected from the group consisting of —H, a branched or linear alkyl radical having from 1 to about 10 carbon atoms and an aryl radical;

wherein:

a is 0–6;

b is 0–7;

c is 0 or 1;

provided a+b+c is not equal to 0;

X is —Cl, —Br, —F, or mixtures thereof when n>1; n is O to 6; and $R_f$ and $R_f$ are independently selected from the group consisting of —F, —Cl, perfluoroalkyl radicals having from 1 to about 10 carbon atoms and fluorochloroalkyl radicals having from 1 to about 10 carbon atoms.

10. The structure of claim 9 wherein said copolymer has an equivalent weight of about 550 to 1200.

11. The structure of claim 9 wherein Y is $—SO_2F$, n is O or 1; $R_f$ and $R_f$ are —F, X is —Cl or F, and a+b+c is 2 or 3.

12. The structure of claim 9 wherein the ion exchange membrane is a cation exchange membrane comprising a polymer containing sulfonic acid groups and carboxylic acid groups.

13. The structure of claim 12 wherein said ion exchange membrane comprises a bilayer ion exchange membrane.

14. The structure of claim 9 wherein said copolymer is blended with a nonionic polymer.

15. The structure of claim 1 wherein said first and second barrier layers are formed by suspending inorganic particles and non-hydrolyzed polymeric particles in a solvent, spraying said suspension on an ion exchange membrane and then hydrolyzing said polymer.

16. The structure of claim 1 wherein said electrode layer comprises a platinum group metal oxide and silver.

17. The structure of claim 16 wherein said one electrode is a cathode.

18. The structure of claim 1 wherein only one electrode layer is bonded to said membrane.

19. The structure of claim 1 wherein said intermediate layers comprise an interpenetration polymer network composition.

20. The structure of claim 19 wherein said interpenetration polymer network composition comprises a mixture of at least one ionic thermoplastic polymer and one nonionic thermoplastic polymer as the binder.

21. The structure of claim 1 wherein each of said intermediate layers comprises a mixture of at least one ionic thermoplastic polymer and one nonionic thermoplastic polymer as the binder.

22. The structure of claim 1 wherein each of said intermediate layers or zones contains a nonionic thermoplastic binder.

23. In an electrochemical cell having an electrode-membrane structure, wherein the improvement comprises said membrane-electrode structure consisting of the structure of claim 1.

24. The electrochemical cell of claim 23 wherein the intermediate layers of said membrane-electrode structure comprise an interpenetration polymer network composition.

25. The electrochemical cell of claim 23 wherein said electrochemical cell comprises a chlor alkali cell.

* * * * *